US010182964B2

(12) United States Patent
Snow

(10) Patent No.: US 10,182,964 B2
(45) Date of Patent: Jan. 22, 2019

(54) DELIVERY OF AUDIO AND TACTILE STIMULATION THERAPY FOR ANIMALS AND HUMANS

(71) Applicant: Copa Animal Health, LLC, Maple Plain, MN (US)

(72) Inventor: Buddy Snow, Wayzata, MN (US)

(73) Assignee: Copa Animal Health, LLC, Maple Plain, MN (US)

( * ) Notice: Subject to any disclaimer, the term of this patent is extended or adjusted under 35 U.S.C. 154(b) by 382 days.

(21) Appl. No.: 14/378,200

(22) PCT Filed: Feb. 11, 2013

(86) PCT No.: PCT/US2013/025571
§ 371 (c)(1),
(2) Date: Aug. 12, 2014

(87) PCT Pub. No.: WO2013/122870
PCT Pub. Date: Aug. 22, 2013

(65) Prior Publication Data

US 2015/0038886 A1 Feb. 5, 2015

Related U.S. Application Data

(60) Provisional application No. 61/597,960, filed on Feb. 13, 2012.

(51) Int. Cl.
*A61H 23/02* (2006.01)
*A61H 23/00* (2006.01)
*A63H 3/00* (2006.01)

(52) U.S. Cl.
CPC ..... *A61H 23/0236* (2013.01); *A61H 23/00* (2013.01); *A61H 23/02* (2013.01);
(Continued)

(58) Field of Classification Search
CPC .... A61H 2201/0134; A61H 2201/1609; A61H 2201/1619; A61H 2201/1652;
(Continued)

(56) References Cited

U.S. PATENT DOCUMENTS 3,880,152 A 4/1975 Nohmura
4,070,553 A 1/1978 Hass
(Continued)

FOREIGN PATENT DOCUMENTS

EP 0 787 476 8/1997

OTHER PUBLICATIONS

Lau, Effect of low-magnitude, high-frequency vibration on osteocytes in the rgulation of osteoclasts, Mar. 6, 2010, Bone.*
(Continued)

*Primary Examiner* — Colin W Stuart
(74) *Attorney, Agent, or Firm* — Kagan Binder, PLLC

(57) ABSTRACT

A system for providing a therapeutic treatment to a mammal for a selected mammalian condition includes a wearable member configured for use about an upper torso of a mammal and an energy module configured to generate energy waves in an energy range particularly configured to provide a stimulation that is therapeutically effective treatment for the selected mammalian condition. The energy module is adapted to be supported by the wearable member about the upper torso of the mammal. The wearable member also includes a therapy delivery portion configured to position the energy module at a treatment site about the upper torso. The underlying idea of the teachings herein is to deliver non-invasive, non-electrical-inducing therapies and energies such as vibroacoustic, physioacoustic, kinesitherapy and phototherapy, through wearable and non-wearable apparatuses to animals and humans for therapeutic treatment.

11 Claims, 15 Drawing Sheets

(52) U.S. Cl.
CPC ..... *A61H 2201/0134* (2013.01); *A61H 2201/0138* (2013.01); *A61H 2201/165* (2013.01); *A61H 2201/1609* (2013.01); *A61H 2201/1619* (2013.01); *A61H 2201/1652* (2013.01); *A61H 2201/501* (2013.01); *A61H 2201/5046* (2013.01); *A61H 2201/5084* (2013.01); *A61H 2201/5097* (2013.01); *A61H 2203/03* (2013.01); *A63H 3/003* (2013.01)

(58) Field of Classification Search
CPC .... A61H 2201/5046; A61H 2201/0157; A61H 2201/1207; A61H 2201/1611; A61H 2201/5005; A61H 2201/5023; A61H 2201/5025; A61H 2201/5035; A61H 23/00; A61H 23/0236; A61H 23/0245; A61H 2203/03; A61H 2205/00; A61H 2205/04; A61H 11/00; A61H 23/02; A63H 3/003
USPC ..... 601/46, 47, 48, 78, 79, 81
See application file for complete search history.

(56) References Cited

U.S. PATENT DOCUMENTS

D261,511 S 10/1981 Hass
4,322,585 A 3/1982 Liautaud
5,101,810 A 4/1992 Skille et al.
5,178,134 A 1/1993 Vago
5,314,403 A 5/1994 Shaw
5,895,348 A 4/1999 Hosaka
5,911,199 A * 6/1999 Farkas ..... A01K 27/009 119/712
5,913,834 A 6/1999 Francais
6,024,407 A 2/2000 Eakin
6,193,677 B1 2/2001 Cady
6,263,836 B1 * 7/2001 Hollis ..... A01K 15/021 119/712
6,615,197 B1 9/2003 Chai
7,335,170 B2 2/2008 Milne et al.
7,445,607 B2 11/2008 Plante
7,981,064 B2 7/2011 Oser et al.
8,077,884 B2 12/2011 Oser et al.
8,079,968 B2 12/2011 Hoffmann
8,092,406 B2 * 1/2012 Gorsen ..... A61F 5/028 601/132
2004/0087936 A1 5/2004 Stern et al.
2004/0097850 A1 5/2004 Plante
2004/0153009 A1 8/2004 Horzewski et al.
2004/0167499 A1 8/2004 Grove et al.
2005/0059909 A1 3/2005 Burgess
2005/0130801 A1 6/2005 Gershman
2006/0005773 A1 * 1/2006 Brown ..... A01K 1/0353 119/28.5
2007/0237808 A1 * 10/2007 Gorsen ..... A61F 5/028 424/443
2008/0110414 A1 5/2008 Buehner
2008/0262350 A1 10/2008 Unger
2009/0005713 A1 1/2009 Podrazhansky et al.
2009/0036805 A1 2/2009 Muggenthaler
2009/0076421 A1 3/2009 Grant
2009/0221943 A1 9/2009 Burbank et al.
2010/0022941 A1 1/2010 Pelkus
2010/0191159 A1 7/2010 Ellin
2011/0017150 A1 * 1/2011 Caputo ..... A01K 15/02 119/719
2011/0125231 A1 5/2011 Ripper et al.
2012/0253236 A1 10/2012 Snow et al.
2013/0030242 A1 1/2013 Ruehring

OTHER PUBLICATIONS

Extended European Search Report from counterpart European Application No. 13749576.8, dated Jan. 22, 2016. (10 pages).
OSIM, "OSIM uCrown 2 Soothing Head Massager with Music", http://www.brookstone.com/osim-ucrown-2-soothing-head-massager-with -heat, Mar. 6, 2014, 2 pages.
JS&A, "Bone Fone", http://blog.modernmechanix.com/bone-fone, Nov. 1980, 3 pages.

* cited by examiner

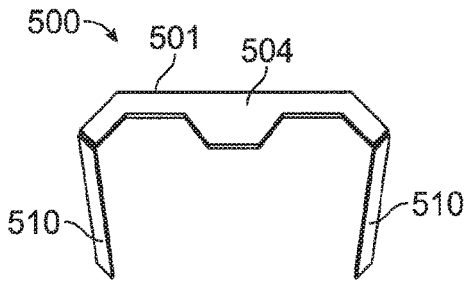
FIG. 5A
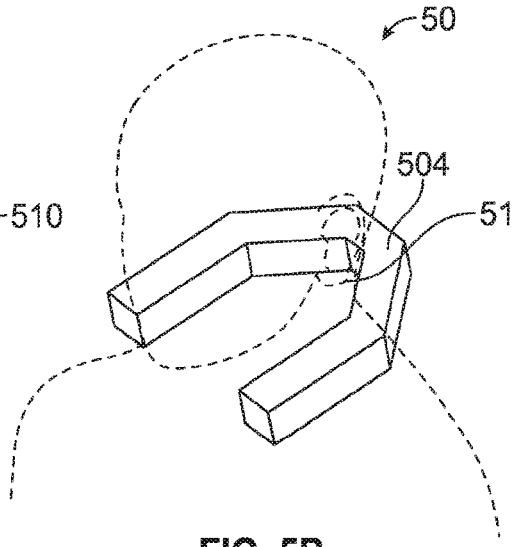
FIG. 5B
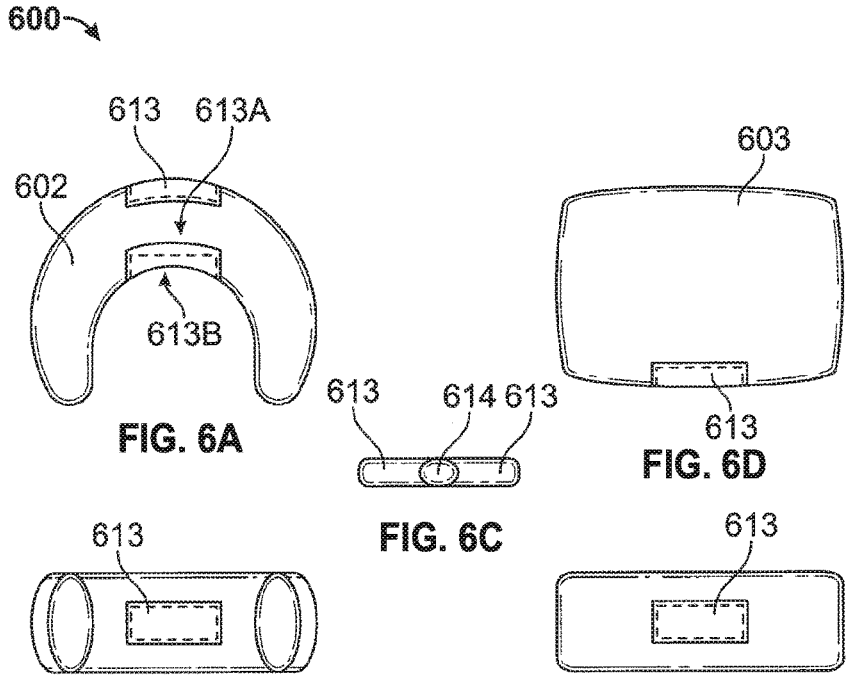
FIG. 6A
FIG. 6D
FIG. 6C
FIG. 6B
FIG. 6E

DELIVERY OF AUDIO AND TACTILE STIMULATION THERAPY FOR ANIMALS AND HUMANS

CLAIM OF PRIORITY AND CROSS REFERENCE TO RELATED APPLICATION

This application claims priority to International Patent Application No. PCT/US2013/025571, filed on Feb. 11, 2013, which in turn claims priority to and the benefit of U.S. Provisional Patent Application Ser. No. 61/597,960, filed Feb. 13, 2012, entitled, "Method and Apparatus to Deliver External Stimulation to Humans and Animals for Therapeutic Effects", the teachings of which are incorporated hereby by reference in their entireties. This application is also related to U.S. Patent Publication No. 2012/0253236 to Snow et al and published on Oct. 4, 2012, which is also incorporated herein by reference in its entirety.

FIELD AND BACKGROUND OF THE INVENTION

The invention is in the field of external therapeutic stimulation and delivery of therapeutic energy to animals or humans.

Today it is well known to provide humans and animals with vibrational therapy through massage chairs, hand massagers, whole body vibration plates, handheld lasers or similar apparatuses that are applied to different parts of the body, sometimes with or without heat. These devices have served to relax the individual by stimulating the nervous system and promoting blood flow and increased oxygen to a particular part of the body to help with conditions and areas such as anxiety, post-operative healing, athletic and general performance, pain, aging, injuries, obesity, and general health. It would be desirable to provide similar therapy options to pets, humans and animals that are convenient and easy to use on a frequent basis, as the brain, nervous system, and body are in a constant state of change and all benefit from new stimulation.

SUMMARY OF THE INVENTION

Vibroacoustic therapy, physioacoustic therapy, along with kinesitherapy and phototherapy, are non-invasive treatment options that have been shown to benefit humans and animals by stimulating the body in various ways. The many benefits include but are not limited to: stress reduction, increased speed to healing, decreases in pain, improve flexibility and other musculoskeletal benefits, increases in blood circulation, improved spine and brain messaging, improved focus and performance, and many others. Transcutaneous electrical nerve stimulation, implantable neurostimulation and similar treatment modalities introduce an electrical signal into the body to deliver therapeutic benefits. The various embodiments described herein seek to improve upon these by providing non-invasive, non-electrical therapeutic systems that deliver the benefits in more user-friendly apparatuses and methods.

The various embodiments disclosed herein are in the field of external stimulation and/or delivery of energy for therapeutic or medical purposes in various delivery mechanisms. More specifically, methods of focused delivery of non-electrical therapeutic energy via vibration, tones, audio, light or other similar energy sources, through wearable and non-wearable members such as collars, harness, halters, clips, belts, beds, pillows, plates, toys, stuffed animals, stand alone systems and attachments, or similar products, sometimes using embedded leads, conductors or other similar materials or methods are disclosed herein. The methods can be administered or delivered in the form of devices, systems or other products for animals or humans. Additionally, other example embodiments disclosed herein utilize wireless, remote and direct communication technology to interact with and control the device placed on or around the mammalian recipients.

In one example embodiment, by delivering therapeutic energy, specifically tones, light and mechanical vibration to the upper torso region, the recipient receives benefit into the brain and cerebellum through ocular, vestibular and peripheral sensory systems. When tonal vibration is received into the ears, the vestibular cochlear nerve activates neurons that send electrical messages to specific end organs to create outcomes such as improved blood flow, which can increase oxygen levels, reduce inflammation and reduce recovery time from injuries. Similarly, when mechanical vibration is generated by an energy source and placed on a mammal, peripheral sensory nerves are activated. These nerves send signals to the receptor areas of the brain to create outcomes such as increased strength to support structures within the body.

In one example embodiment, a system for providing a therapeutic treatment to a mammal for a selected mammalian condition includes a wearable member configured for use about an upper torso of a mammal. An energy module is included that is configured to generate energy waves in an energy range particularly configured to provide a stimulation that is therapeutically effective treatment for the selected mammalian condition. The energy module is adapted to be supported by the wearable member about the upper torso of the mammal. The wearable member also includes a therapy delivery portion configured to position the energy module at a treatment site about the upper torso. The underlying concept of the teachings is to deliver known non-invasive, non-electrical-inducing therapies and energies such as vibroacoustic, physioacoustic, kinesitherapy and phototherapy, through wearable and non-wearable apparatuses to animals and humans.

In another example embodiment, an apparatus for delivering therapeutic energy to at least a portion of a mammal for a selected mammalian condition comprises a therapy output device adapted to generate energy waves in an energy range configured to provide a therapeutic effect on a mammal. The apparatus further includes means for controlling the therapy output device with the controlling means including an amplifier, memory, and an audio file playing module. The apparatus further includes a power supply means operationally coupled to controlling means and to the therapy output device and a housing configured to enclose the therapy output device, controlling means and power supply means therein.

In yet another example embodiment, a system for providing a therapeutic treatment to a mammal for a selected mammalian condition comprises an energy module adapted to generate energy waves in an energy range configured to provide a therapeutic effect on a mammal. The system also includes means for delivering the energy waves from the energy module to a treatment site, the energy delivering means being coupled to the energy module, wherein the energy delivering means is configured to direct the energy waves proximate to the treatment site of the mammal.

In various example embodiments, the wearable devices are made from or include materials that help to transfer the therapeutic energy throughout the collar and are made from materials that are stretchable, lightweight and adjustable so that apparatus can be secured tightly to an animal and not be constrictive. Such devices have additional components, channels, or other elements to monitor, interact with, direct, control, or similarly embedded elements. In a related example embodiment, an apparatus such as a pad or plate is provided that includes a delivery of therapeutic energy. Such an apparatus may be constructed of pliable or rigid materials and it can be attached to crates, kennels, or similar to deliver therapeutic energy to animals. In yet another related embodiment, there is disclosed a method of delivering therapeutic energy as described herein that can be attached to chairs, beds, or similar items. In yet another embodiment, a device is provided that has flexible arms to grip the neck and locates the therapy output device at the upper torso or at the neck or spine area. Such an apparatus may also have foldable arms.

BRIEF DESCRIPTION OF THE DRAWINGS

FIGS. 5A-5B shows a wearable device that is placed on or around the neck of a human and incorporates a therapeutic delivery method.

FIGS. 6A-6E illustrates top and bottom views of wearable and non-wearable pillows, respectively, that include a pouch or pocket to hold a therapeutic delivery device illustrated in FIG. 6E.

DETAILED DESCRIPTION OF THE INVENTION

The various example embodiments disclosed herein include various methods and apparatuses to deliver non-invasive external therapeutic stimulation, specifically tones, vibration, and light, to animals and humans. Apparatuses include wearable embodiments such as animal harnesses, collars, wraps, shirts and halters, as well as human neck pillows, neck wraps and shirts. Non-wearable embodiments include pillows, plates, chair and kennel attachments, balls, toys and stuffed animals. In each apparatus, a method or device to deliver therapeutic stimulation is inserted or attached. FIGS. 1 through 7 describe wearable form factors; FIGS. 8 through 11 detail simple and easy to use delivery methods or devices; and FIGS. 12 through 17 show non-wearable form factors.

Figure 1:
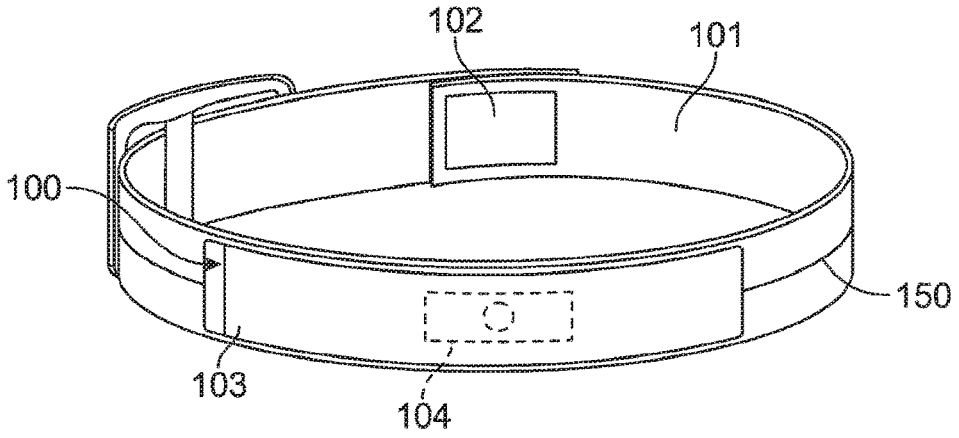
FIG. 1 shows a wearable collar or member that is placed around the neck of a mammal with a pouch or pocket to hold, or a base plate to attach, a therapeutic delivery device.

Referring now to the Figures, FIG. 1 describes an example embodiment of a therapy system 100 that includes a wearable collar or band member 101 with clasp 102 that is placed around the neck of a mammal with a pouch or pocket 103, or a base plate to attach, to hold a therapeutic delivery device 104 on top of a neck or along a spine of a mammal. Pouch 103 (or pocket or base plate) is positioned to hold therapy device 104 in place on top of the neck and along the spine so as to deliver therapeutic energy that can be heard easily through the ears, felt easily along the spine and into the brain, and perceived easily by the eyes. The additional benefit of these embodiments is to allow the simple removal of therapy device 104 to be recharged, repaired or replaced, without removing wearable member 100.

Still in more detail of FIG. 1, the construction of the collar or band or wearable member 100 includes the following: a band made from lightweight and breathable materials and fabrics so as not to be constrictive to the animal or mammal. An adjustable strap (such as 101) is placed around the neck between the head and front legs and fitted snugly to secure it in place. The adjustable strap around can be looped through a hook and secured by a hook and loop system clasp 102, buckle or similar method. A pouch or pocket 103 that has a slot or opening with a flap closure to allow easy and secure access to attach and remove device 104, such as needed to recharge, change settings, replace, or similar. A base plate (not shown) can be placed into the harness with the function being to attach and secure therapeutic delivery device 104. Extension leads 150, conductive materials or similar elements could be embedded or inserted into the harness so as to help transfer the vibrations coming from the therapeutic device and spreading throughout the harness to help deliver the therapy.

Figure 2:
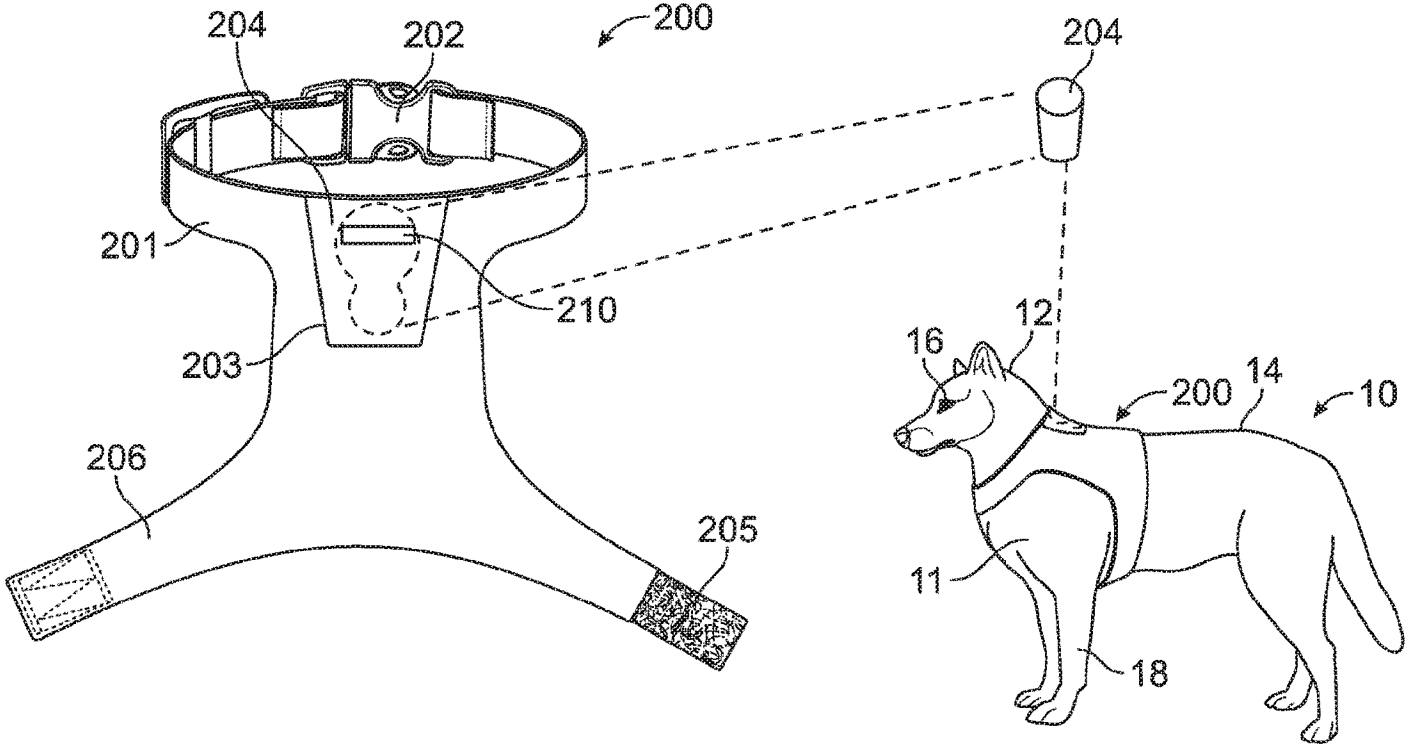
FIG. 2 shows a harness that is placed on an animal such as a dog or cat, with a pouch or pocket to hold, or a base plate to attach, a therapeutic delivery device on top of a neck or along a spine of the animal.

FIG. 2 in greater detail describes a wearable harness 200 comprised of collar 201 with clasp 202 and a support band member 206 that is placed on an animal 10 and includes a pouch or pocket 203 to hold, or a base plate to attach, a therapeutic delivery device 204. The pouch, pocket or base plate (therapy delivery portion) 203 is positioned to hold device 204 in place on top of 12 neck and along spine 14 so as to deliver vibrational energy that can be heard easily through the ears, felt easily along the spine and into the brain, and perceived easily by 16 eyes. The additional benefit of these embodiments is to allow the simple removal of device 204 to be recharged, repaired or replaced, without removing the wearable member.

Still in more detail of FIG. 2, the construction of the harness 200 with support band member 206 includes the following: a band made from lightweight and breathable materials and fabrics so as not to be constrictive to animal 10. An adjustable strap or support member 206 is placed around an upper torso 11 and/or neck 12 behind front legs 18 and fitted snugly to secure it in place. Adjustable strap 206 around the torso can be looped through a hook and secured by a hook and loop system 205, or a clasp, buckle or similar method. A pouch or pocket 203 that has a slot or opening with a flap closure 210 to allow easy and secure access to attach and remove device 204, such as needed to recharge, change settings, replace, or similar. A base plate (not shown) that is placed into or onto the harness with the function being to attach and secure therapeutic delivery device 204. The extension leads, conductive materials or similar method (not shown) can be embedded or inserted into the harness so as to help transfer the vibrations coming from the therapeutic device and spreading throughout the harness to help deliver therapy. An adjustable collar 201 and clasp 202 placed around the neck of the animal to help hold the pouch in position and securely on the animal. In a related embodiment, an adjustable breast strap that is attached to the underside of the collar to the underside of the torso strap and between the front legs includes a blood pressure or heart rate monitoring system that connects to and activates device 204.

In order to deliver the therapy, device 204 or similar therapeutic device, is inserted and placed securely into the slit opening of the pouch or pocket, or snapped into the base plate. Once positioned on top of the neck and spine, the device can be activated as needed so as to deliver tonal and vibrational energy for a set time. The tonal and vibrational energy is delivered at specific frequencies that activate or inhibit certain mechanisms or functions in the mammalian body. Device 204 includes a mini vibration speaker that delivers both tactile and audio sensory vibrational stimulation through a range of frequencies. Frequencies that have proven effective range between 15 Hz and 300 Hz, and mimic very closely to those that are generated by tuning forks. Melodic music and recorded heartbeats played through speakers also has calming effects. Therapy times range between 2 minutes and 20 minutes, with an average treatment time of about 10 minutes. In a canine example, 10 minutes of therapy that incorporated a frequency of 128 Hz with a recorded heartbeat at 60 beats per minute was administered. A visual post assessment of this dog showed she was much calmer, while a thermograph indicated her back had reduced inflammation, as seen by reduced temperature. By using the therapy on a regular, daily or frequent basis, the dog will not only stay calmer, but through nervous system activation and neuroplasticity, her pain levels will decrease and her mobile performance will improve. Vibration therapy promotes the fracture healing in rabbits regardless of the frequency but in other mammals the frequency as well as the magnitude are important. Both bone strength and speed of fracture healing are better than those not receiving vibration therapy. In addition, bone strength is elevated by 20% approximately 30% by the best stimulation of stress. The best frequencies are 25 Hz and 50 Hz, while the second best are 12.5 and 100 Hz and then, 200 Hz.

Figure 3:
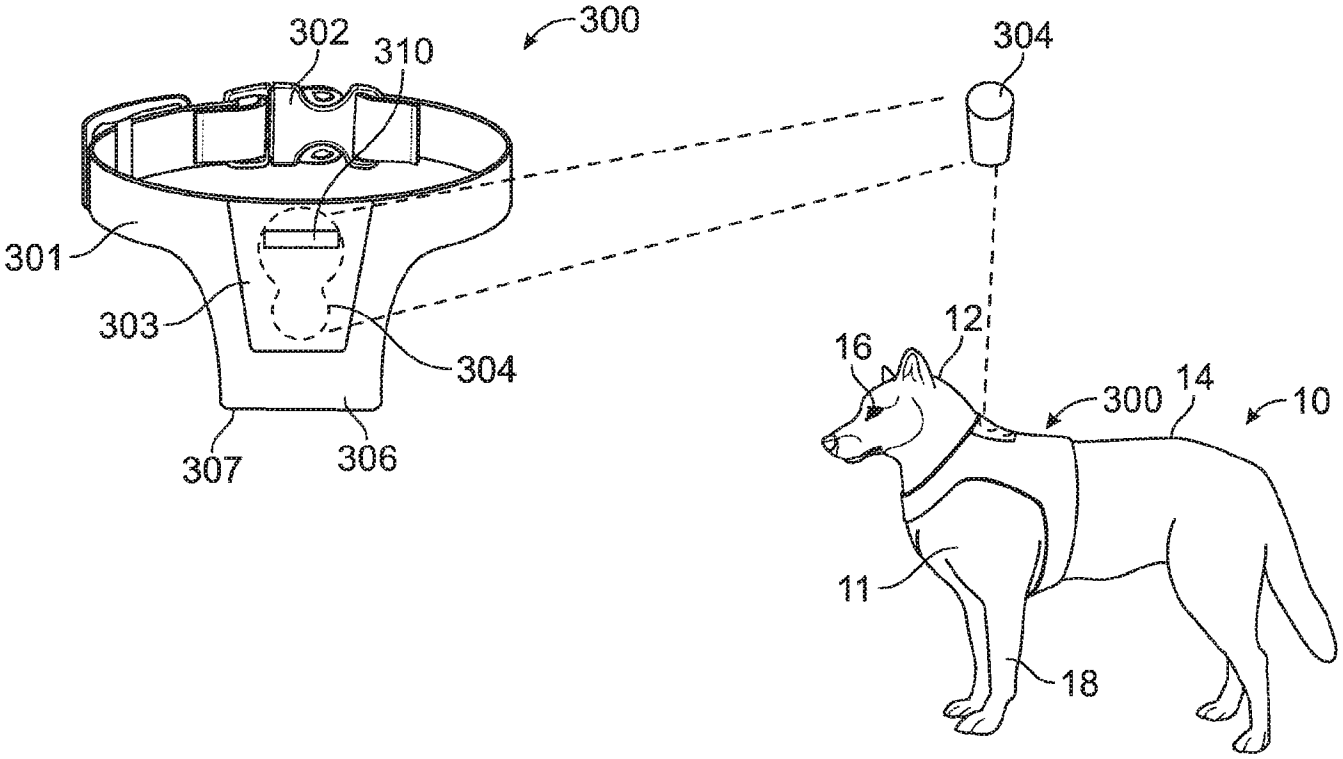
FIG. 3 shows a collar that is placed around a neck of an animal with a pouch or pocket to hold, or a base plate, to attach a therapeutic delivery device on the top of the neck or along the spine of the animal.
Figure 3A:
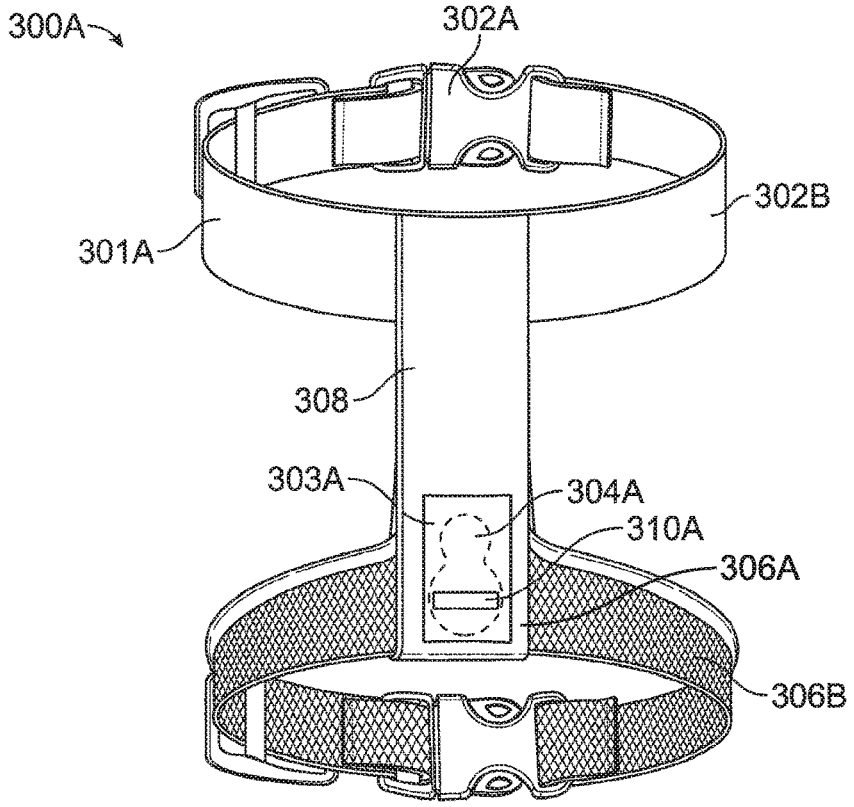
FIG. 3A shows a wearable member secured around an upper torso of an animal or, attaches to an existing collar.

Referring now to FIGS. 3 and 3A, FIG. 3 shows a therapy system 300 that includes a wearable collar 301 that is placed and worn around neck 12 of an animal 10 that includes a pouch, pocket 303 or base plate (not shown) to hold a therapeutic delivery device 304 on top of the neck and along spine 14. The pouch, pocket or base plate 306 extends from the front of the collar near the head of the animal and back towards the rear. It may have a rigid border 307 to help hold the pouch on top of the spine and to keep it from slipping under the neck. The benefit of this design is a smaller form factor than system 200, without the need for the band around the torso.

In one example embodiment of the therapy, a therapy deliver apparatus described in system 300 was applied to seven canines that were suffering from anxiety, were administered the therapy for five minutes each by placing the collar around the neck of the animal, positioning the device on top of the spine, and activating the device. The therapy source was an audio file that played a series of tones ranging from 65 to 300 Hz through the vibration speaker that could be heard and felt by the animals. A veterinary behaviorist measured anxiety symptoms, along with heart rate readings and echograms assessments. On six out of seven dogs, a significant decrease in all measurements was recorded.

In another example embodiment of the therapy, a therapy delivery apparatus described in system 300 was applied to one dog with severe separation anxiety that obsessively licked the floor while the owner got ready to leave the house was administered the therapy for five minutes for three days in a row. Each time after device activation, the dog stopped the licking behavior and sat calmly by the owner's feet. At the end of the three day trial, the owner observed that the dog's anxiety was significantly improved, indicating that a wearable system that is used consistently would result in positive outcomes.

The construction materials and delivery of therapeutic energy are similar to those described in the other therapy systems described above. Referring now to FIG. 3A is a wearable band 301A with clasp 302A that has a pouch, pocket 303A or base plate that sits on top of the neck or spine of an animal to hold therapeutic delivery device 304A, and is placed and secured around the torso. A unique feature of this is adding the ability to connect device 304A to an existing collar via extension 308 that includes support member 306A. This benefit allows the owner to use the band for therapy in conjunction with using their existing collar 301A. The construction materials and delivery of therapeutic energy are similar as those described in earlier therapy systems above. Support member 306B is made of a mesh-like material in this example. Pocket 303A includes a flap 310A to enclose device 304A in this example.

Figure 4A:
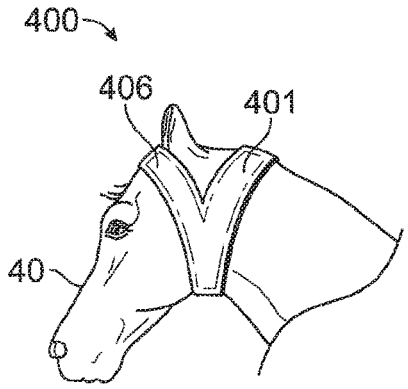
FIGS. 4A-4C illustrates a halter or wearable member that is placed around the neck and over and around the ears of an animal such as a horse or cow.
Figure 4B:
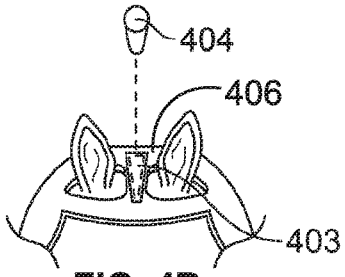
Figure 4C:
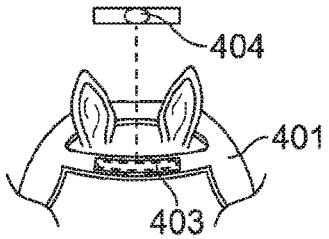

Referring now to FIGS. 4A-4C, a therapy system 400 is shown which includes a wearable halter 401 with size adjusting material that is placed around the neck and ears of an animal such as a horse 40 or cow that includes a pouch, pocket 403 or base plate 406 that sits between or near the ears to hold a therapeutic delivery device 404. A unique feature of this design is having the ability to keep device 404 in place near the ears and over the brain and spinal column. In FIGS. 4B and 4C, the construction materials and delivery of therapeutic energy are similar as those described in the Figures above.

Figure 8A:
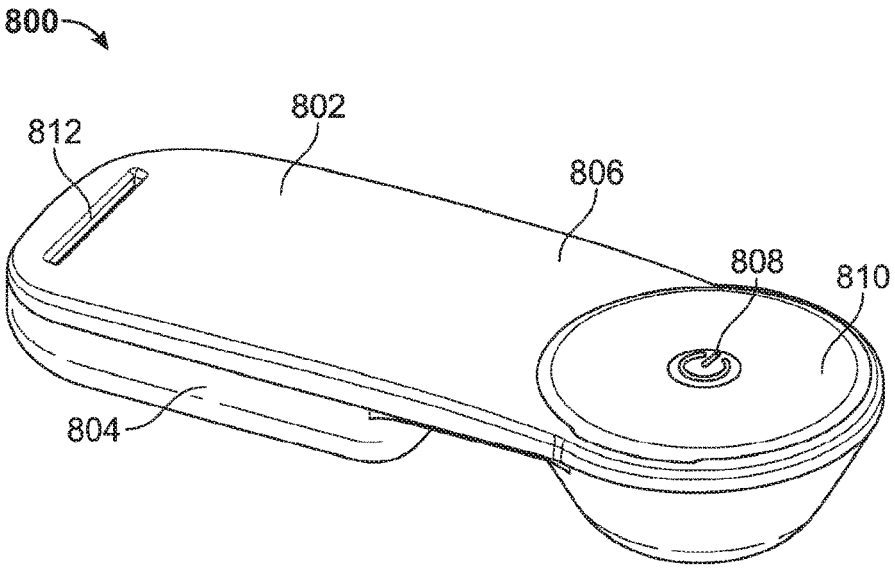
FIGS. 8A and 8B illustrate a therapeutic delivery device that is attached to or placed in the pouch, pocket, or base plate of the various Figures listed herein.
Figure 8B:
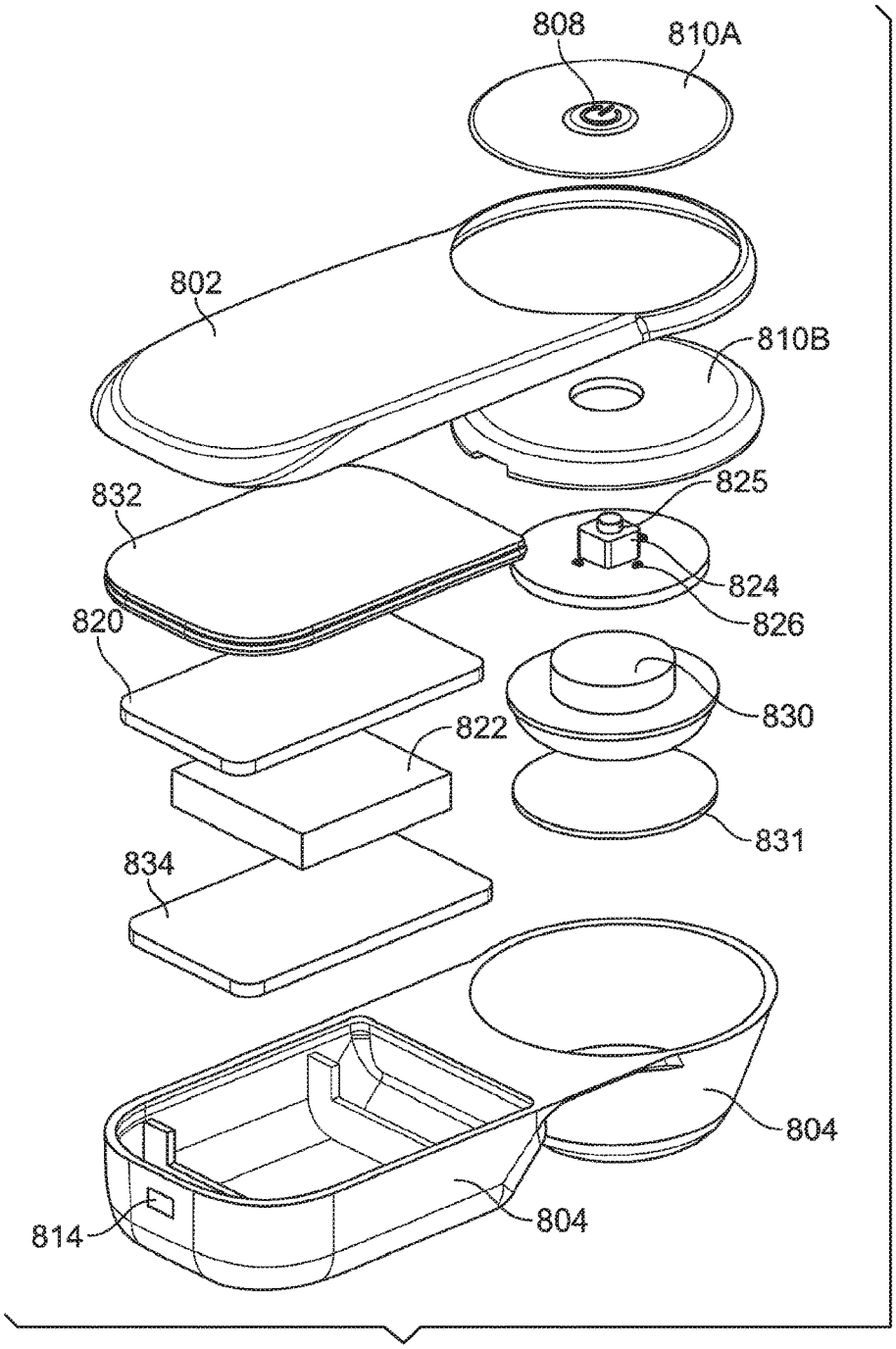
Figure 8C:
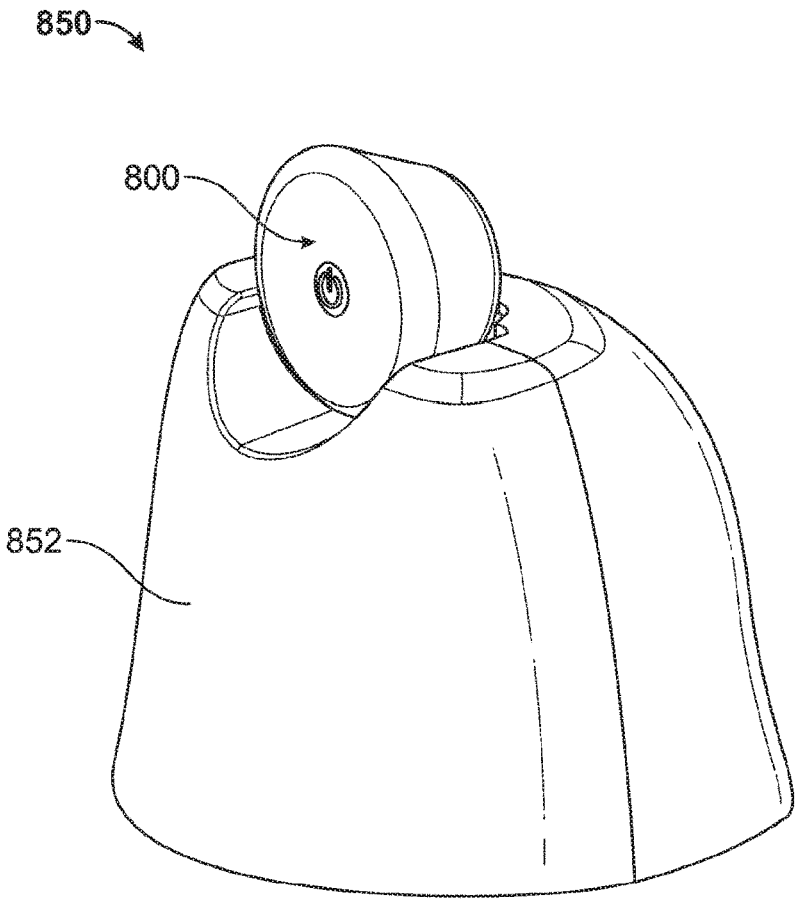
FIGS. 8C and 8D detail a charging stand that can be used with the device described in 8A.
Figure 8D:
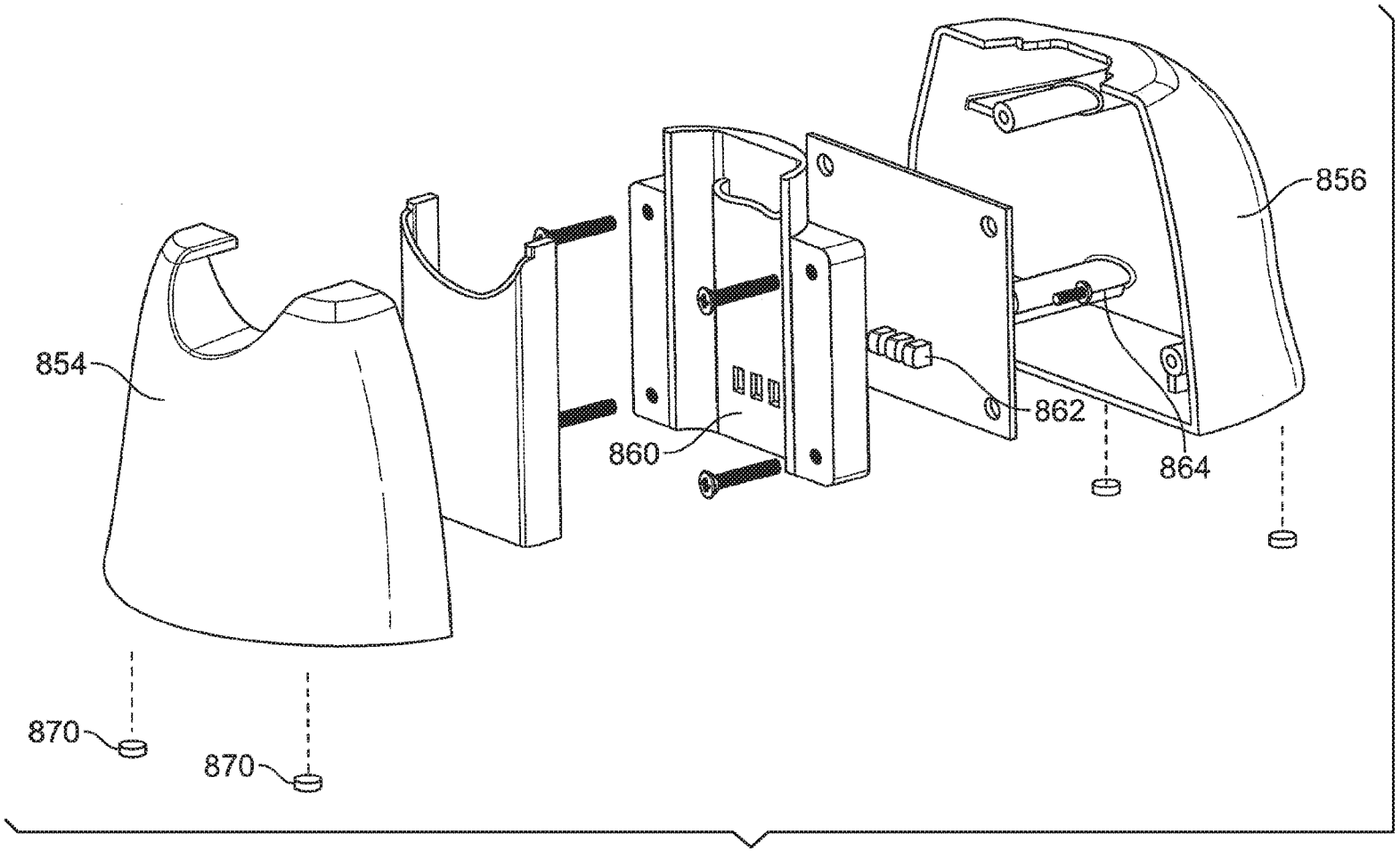
Figure 9:
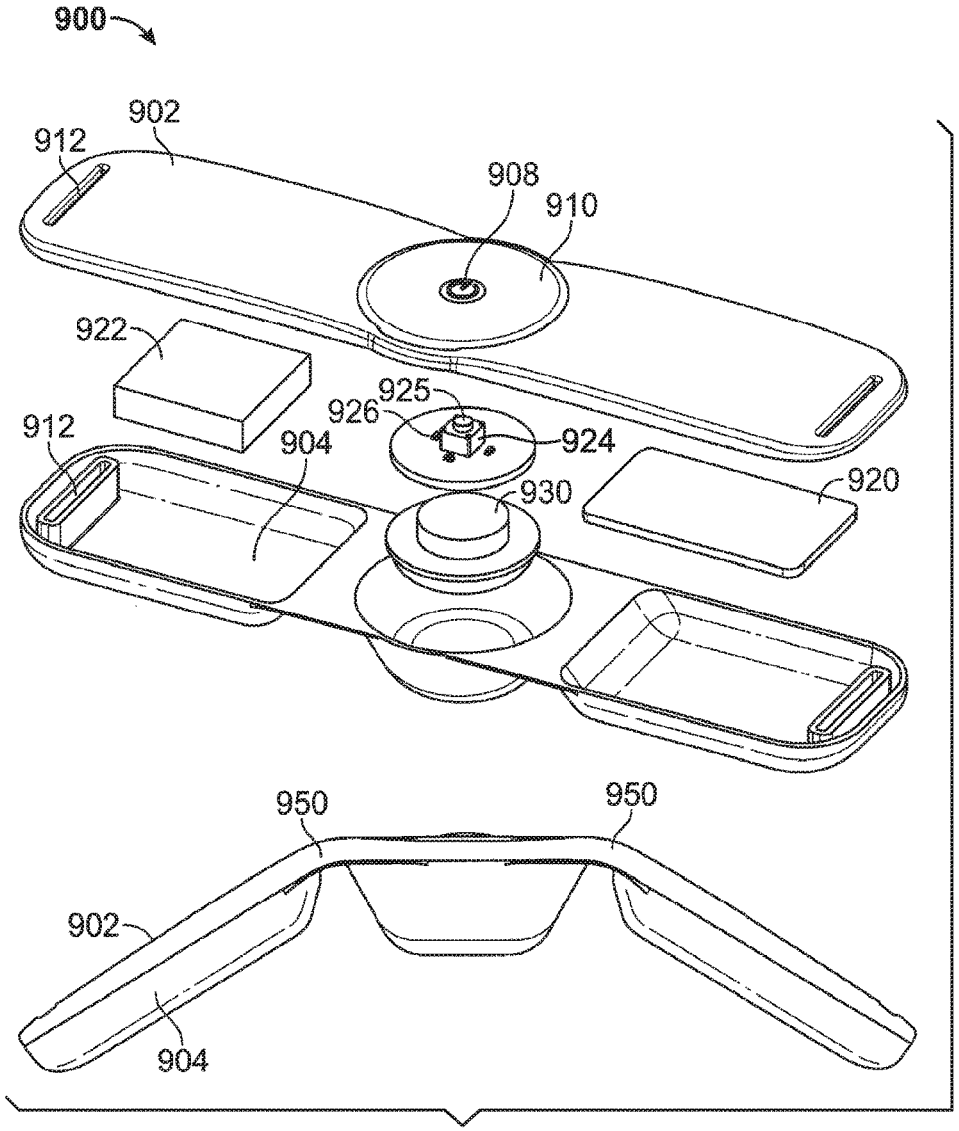
FIG. 9 illustrates an elongated therapeutic delivery device that distributes the internal components to make a unit longer and with a less height form factor.

Referring now to FIG. 5, a therapy device 500 is shown that includes a wearable device 501 that is placed on and around the neck 51 of a human 50 and incorporates a therapeutic delivery device 504 such as described in more detail in FIGS. 8 and 9. In this example embodiment, device 500 has a main body 501 and has a tensile-based, retractable, foldable or similar arm extensions 510 to hold the unit 504 securely in place on the back of the neck. The arm extension (or extensions) are foldable similar to sunglasses and securely stored when not in use. Uses for this type of device 500 include anxiety, balance and stability, training, performance improvement and recovery for sports such as golf, relaxation and focus for travelers and professionals such as doctors. Construction materials for device 500 could be similar to those listed in Figures above and the delivery of therapeutic energy is similar as those described in the Figures above.

In one example embodiment, device 500 was successfully used on nine humans with balance and stability issues, along with reduced kinesthetic strength and elevated blood pressure, were given the therapeutic device to wear around the neck for five minutes. On each human, balance, stability, blood pressure and kinesthetic strength were improved by delivering vibrational and tonal energy in the ranges of 45 through 250 Hz. Additionally, two of these patients suffered from shoulder and knee pain. After the therapy was administered, both patients indicated that their level of pain had been reduced dramatically.

Referring now to FIGS. 6A-6E, there are illustrated top and bottom views of other therapy systems 600 including both wearable 602 and non-wearable 603 pillows that include a pouch or pocket 613 to hold a therapeutic delivery device 614, which is illustrated in FIG. 6E. Pillow 602 can be placed and worn on the neck of an individual while traveling, sitting in chairs, or resting. Pillow 604 can be used while lying down, sleeping, resting in a seated position, or similar.

Referring again to FIG. 6, pouch or pocket 613 to hold delivery device 614 can be placed in the front pouch 613B, closer to the wearer, or in the rear pouch 613A, to allow for easier access. The pouch or pocket can be accessed and secured in place by a foldable lining, a zipper, buttons, or similar method.

Figure 7B:
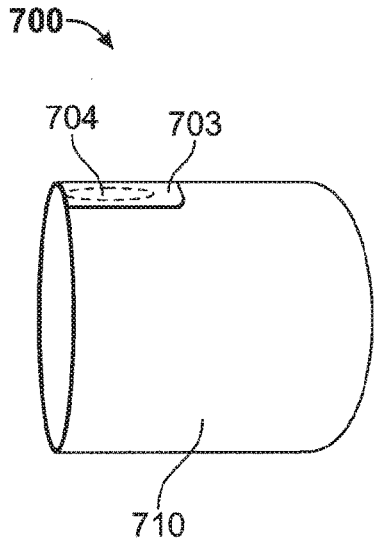
FIGS. 7A-7B illustrate front views of a shirt and a wrap, respectively, that can be worn by animals or humans that include a pouch or pocket to hold, or a base plate, to attach a therapeutic delivery device.
Figure 7A:
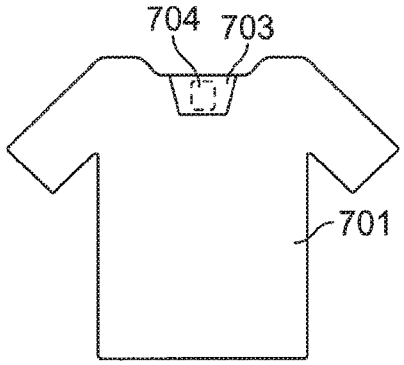

Referring now to FIG. 7, there is shown therapy delivery system 700 that includes a wearable shirt 701 and an animal wrap or shirt 710, both for animals and humans that include a pouch or pocket 703 to hold a therapeutic delivery device 704 on the back of the neck and along the spine of the subject. Animal shirt or torso wrap 710 is placed on an animal with the pouch pocket 703 (or base plate) sitting along a spine, near the upper torso and neck region of the subject. Construction materials are similar to previous descriptions and Figures listed herein. Shirt 701 for humans can be worn with a pouch or pocket 703 on the back, on the upper torso, and potentially included in the neck collar. Construction materials, manufacturing methods and fabrics are similar to known shirts, and to those listed herein.

Referring now to FIGS. 8A-8D, FIG. 8A shows a therapeutic delivery device 800 that can be inserted into or attached to the therapy delivery systems described herein, or used by itself. In this example embodiment, unit 800 includes a housing 802 comprised of a rigid bottom plate 804, flexible top overlay 806, a controller push button 808, lighted top display 810, an opening 812 to attach or hold automatic or wireless controls. Unit 800 also includes a port 814 (not shown) near opening 812 to be used as a data and communication port. The benefits of this design are a short form factor, flexible mid-plate and lightweight so as to be easily worn.

Referring now to FIG. 8B, there is shown the internal components to FIG. 8A that may include a programmable control board 820 that includes energy generating sources such as audio files, a power source such as a battery 822, a micro switch 824 with a support plate 826, a wireless connectivity operation member 832, an accelerometer or other monitoring device 834, and a vibration speaker or transducer device or therapy output device 830, an LED light source 825 or similar method to output therapeutic vibrational energy. The unit can also include functionalities such as an accelerometer, wireless connectivity, and vitals monitoring capabilities. A therapy output device support plate 831 and a control button cover 810B is also included.

Referring further to FIGS. 8C and 8D, there is shown a therapy device and charger system 850 that includes therapy unit 800 and charging station 852 and/or communication portal for device 800 described in FIG. 8A. One benefit of incorporating such a station into the system is to move charging mechanisms off of the device and onto the base unit, thus decreasing the weight and size of the wearable device. Charging station 852 includes a front 854 and back cover 856, a receptor plate 860 with ridges to hold device 800, power recharging board 862 and communication ports 864 to access device 800. Optimal hose plugs 870 prevent slipping of station 852.

Referring now to FIG. 9, there is shown exploded and side views of therapy unit 900 of a different form factor of a therapeutic delivery device 900 described in FIGS. 8A and 8B. The internal components and product features are similar and include a housing comprised of a top cover 902, a bottom pliable member 904 (and a lateral protruding member), a control button 908 and cover 910, attachment opening 912, control board 920, a battery 922, micro switch 924, LED 925, switch support plate 926 and a therapy output device 930, such as a speaker or transducer. The benefits of this design are a lower height form factor as the components are distributed, and a longer form factor for additional therapeutic touch points by the lateral protruding member or members 904 to the mammalian recipient with a bendable portion 950 to accommodate mammal form.

Figure 10:
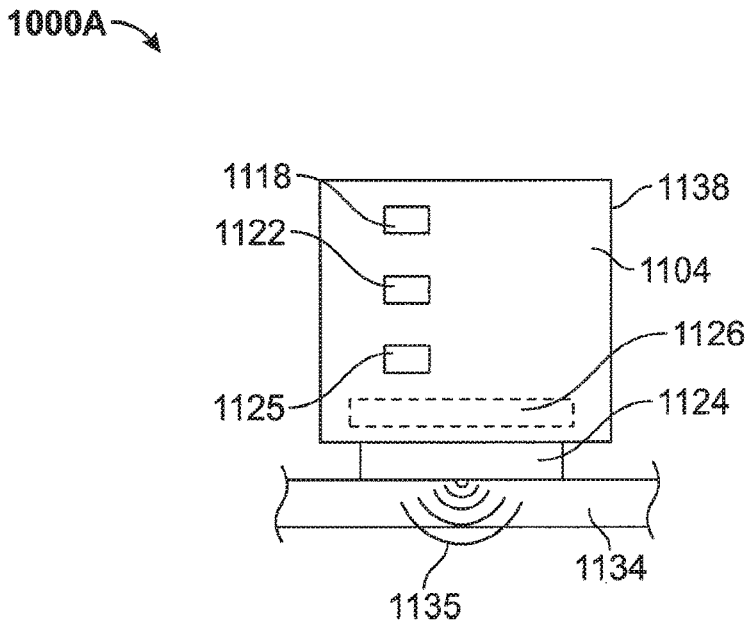
FIG. 10 illustrates a non-wearable therapeutic delivery device that delivers low frequency tones, audio and resulting vibrations out of the device.
Figure 11:
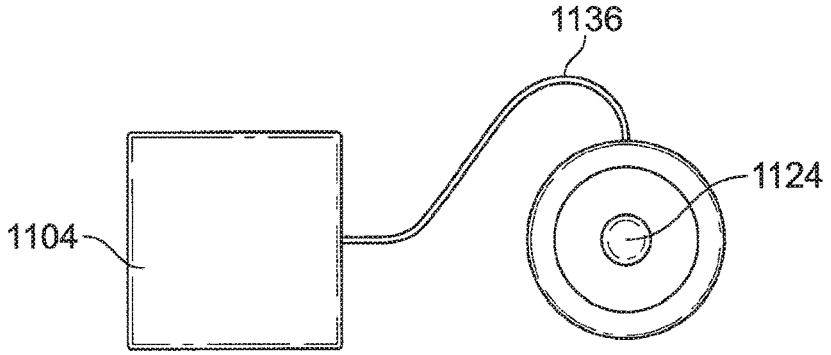
FIG. 11 is another embodiment of a vibration speaker delivery system.

Referring now to FIGS. 10 and 11, there are shown non-wearable, external, stimulation devices, 1000A and 1000B respectively, to deliver vibration, tones and audio waves 1135 to humans and animals for therapeutic purposes. These devices have a power mechanism, volume, and intensity controls, a power source, a rechargeable outlet, and a mechanism to store data or stimulation methods on the device. This data can be in many forms such as tones, music, and the like. This device can be used as pictured, as a stand-alone product, as whole inside other delivery products such as below, and also broken into components and used in different forms. Also described are ways to remotely or wirelessly control and interact with the system, such as simple handheld devices, keypads, touch screen, or similar devices. These devices can be in many shapes and forms, and the components detailed below can be used separately without the specifically described structures.

In various example embodiments, included with the devices are components such as a:

Power button 1118—to turn the control panel on or off

Vibration or other similar speaker 1124 to deliver vibrations, tones or audio into humans or animals for therapeutic benefits by way of or through a plate 1134 (rigid or pliable)

Data port 1125, hard drive, or other similar method to store and deliver

Battery 1126 or other device for storing power to operate the device

Within a housing 1138

Electronics operating board for controlling the device (not shown)

Volume controls 1122

Indicator lights—showing which stimulation method is selected or active

Plug-in—for external power or audio loading (or data loading) 1125

Remote control to operate device without having to manually touch (via cable 1136 in FIG. 11)

Wireless port—to remotely connect to device

Still referring to FIGS. 10 and 11, when the user turns on the device, consistent energy in the form of vibration, tones or other frequency energy is delivered through vibration speaker 1124 and into an attached surface or plate 1134. Here, the human or animal will interact, hear or feel the vibrational energy for health benefits for a set period of time. The user can manually turn off the device or it will turn off automatically after a set period.

The vibration, tones or audio functions will be available in multiple levels that can be controlled via the mode button and stored on the disk drive. The wireless port allows the user to control the unit from a remote location, via a handheld, remote, or other similar communication method a Wi-Fi system connected to the Internet. The materials and surfaces described below that the system attaches to or is included into, may have leads, specific materials or other transmittal components embedded into it to deliver stimulation more consistently through the products. The construction details of the invention in FIGS. 10 and 11 include the system being made from metal, plastic, ceramic, glass (hardened) or other casing material.

Figure 12A:
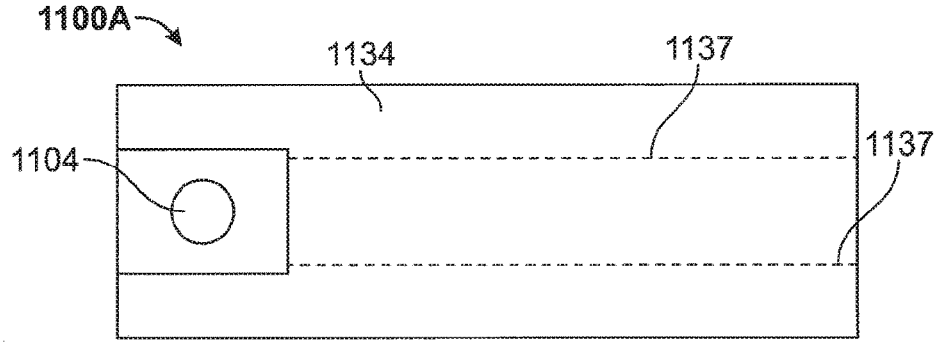
FIGS. 12A-12B illustrate top and side views of a delivery mechanism where the Treatment system is enclosed and attached to a surface to help deliver the therapy over a longer distance.
Figure 12B:
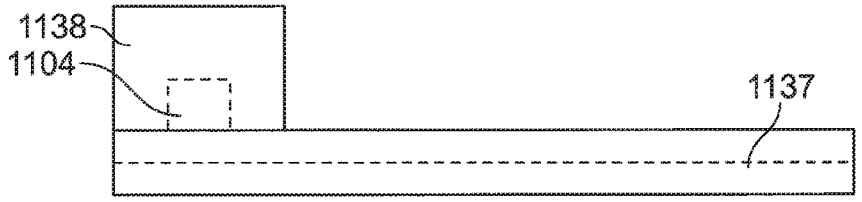
Figure 13A:
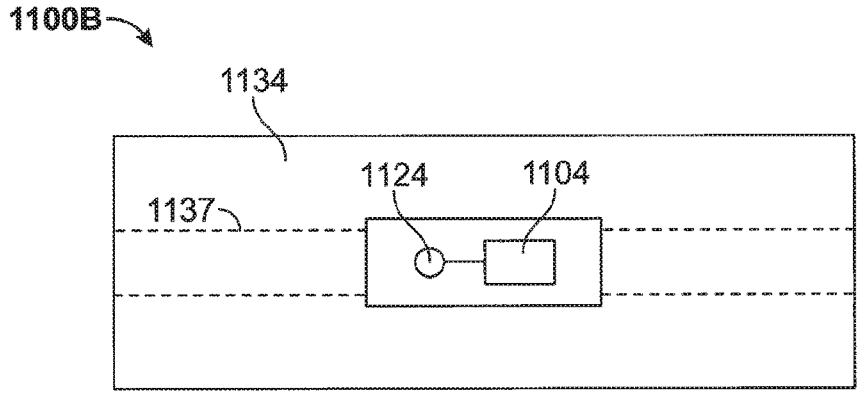
FIGS. 13A-13B illustrate top and side views of the Treatment system to be included inside the product for a flat surface.
Figure 13B:
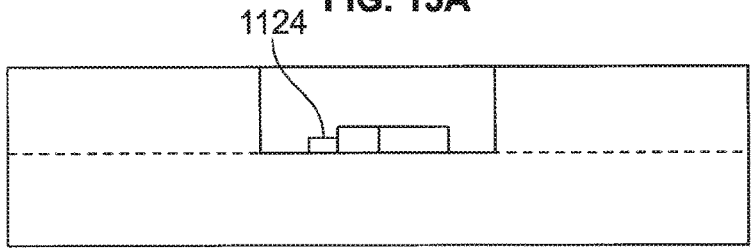
Figure 14:
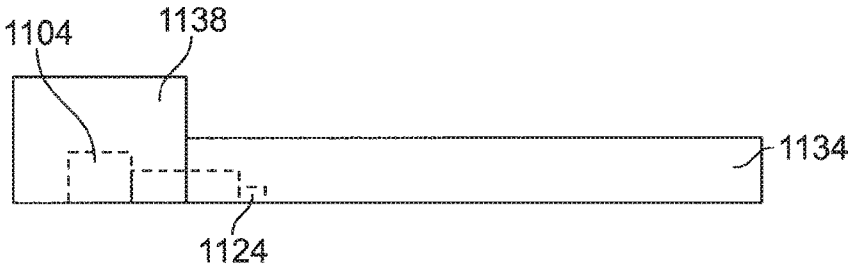
FIG. 14 illustrates another way of attaching the system to a surface and allows the system to be outside of the mechanism of delivery and still delivering stimulation.

Referring now to FIGS. 12, 13 and 14, (like components from FIGS. 10 and 11 are used) are top and side views of other therapy systems 1100A and 1100B of delivering external therapeutic stimulation by attaching the system to pliable and rigid surfaces 1134 made from materials such as wood, metal, plastic, ceramic, thick glass or other similar hard surface. The various systems can be attached directly to surface, inside an enclosure 1138 via speaker 1124 that is on top, embedded inside, or on the side of the delivery surface or plate. In a related embodiment, electrodes or leads 1137 are included to help deliver therapy. A main benefit of this method is to allow for secure, safe and reliable ways of delivering the stimulation over a larger surface for uses such as next to, or included into, products such as pillows, mattresses, beds, crates or other similar surfaces. These can help calm, heal, decrease pain, or have other beneficial uses.

Figure 15A:
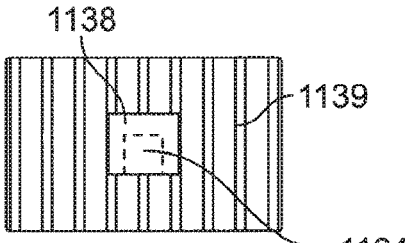
FIGS. 15A-15C illustrate views of a standard crate and a crate with crosslink pattern and a side view of a method of attaching a treatment system externally to pet housing products.
Figure 15C:
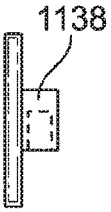
Figure 15B:
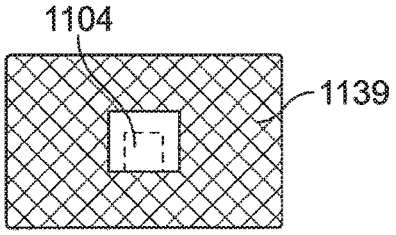
Figure 16A:
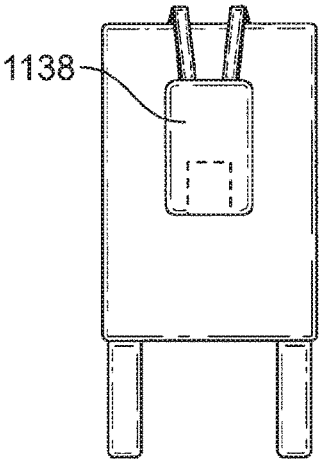
FIGS. 16A-16B illustrate rear and side views and a method of externally attaching a treatment system to products such as chairs or recliners for calming or reducing stress.
Figure 16B:
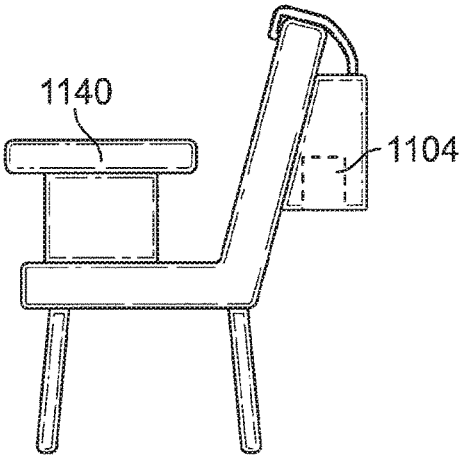

Referring now to FIGS. 15 and 16, are described other methods and form factors of attaching the therapy systems, such as 1138, disclosed herein, safely, securely and therapeutically to surfaces, enclosures, such as crates 1139, kennels, chairs 1140, or other fixed surface where animals or humans sit 1140, lie down or spend time. Benefits here include simple ways of delivering stimulation to help calm, heal, decrease pain, or other similar uses, in various attachment formats.

Figure 17A:
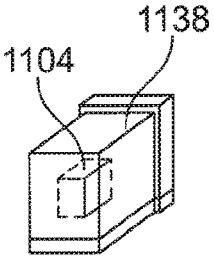
FIGS. 17A-17C illustrate views of a box, a ball and a stuffed toy as separate forms of delivering the system that do not attach to other products.
Figure 17B:
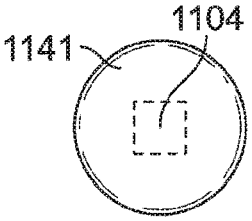
Figure 17C:
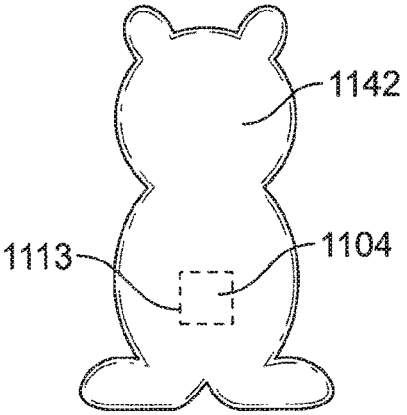

Referring now to FIG. 17, shown therein are methods of delivering the system in an enclosed box format 1104, for uses such as on a tabletop or other hard surfaces, and in formats such as a ball 1141 or other shape such as a toy or stuffed animal 1142, for uses inside kennels, crates, or other similar enclosures. Health benefits are similar to above descriptions. Additional benefits include: 1) safety issues as protection from falling, chewing, etc.; 2) mobility to take and use any places; and 3) security from dust and other harmful effects over just using the system as a standalone device.

Figure 18:
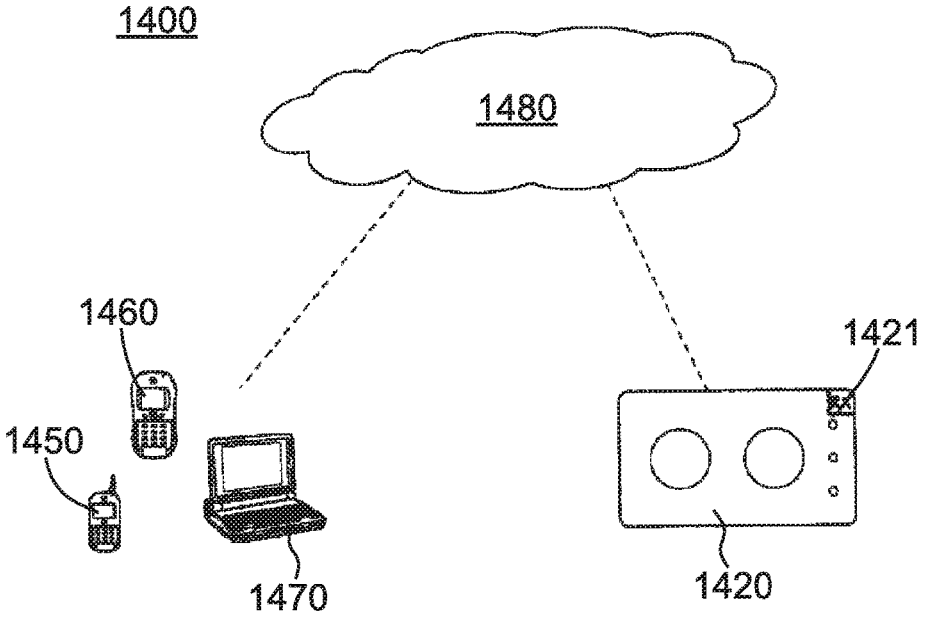
FIG. 18 is a system of communicating remotely with the collar of FIG. 1, from any location through a handheld or similar communication device, according to the teachings of the invention device.

Referring to FIG. 18, in more detail, is a system 1400 for communicating with external animal devices, such as a control panel 1420, via a remote 1450, handheld 1460, computer 1470, wireless or other similar technology or device through the internet or cloud computing system 1480. A wireless port or receiver 1421 is embedded into control panel 1420 and allows users to program, change, modify, start, stop or other function, the device or system. Wireless port 1421, allows the user to control unit 1420 from any location, via a handheld, remote, or other similar communication method and through internet 1480.

The following U.S. patents and publications are herein incorporated by reference in their entirety: U.S. Pat. Nos. 5,101,810; 5,178,134; 5,314,403; 5,895,348; 6,024,407; 6,193,677; 6,615,197; 7,445,607; 7,981,064; 8,077,884; and 8,079,968.

Other known vibrational systems include: the X-Vibe Vibration Sound System (www.innovationx.tv) and the Smart Vest and VibraMax Systems by Nexneuro (www.nexneuro.com), but these fail to provide the form factor and simplicity provided by the various embodiments described herein.

This written description of the invention enables one of ordinary skill to make and use what is presently described. A person of ordinary skill should understand and appreciate that there are variations and combinations to the methods described herein, and should therefore not limit the invention to what is described, but by all the embodiments and methods within the scope and spirit of the invention.

The invention claimed is:

1. A method for delivering therapeutic stimulation to at least a portion of a treatment site of an animal comprising the steps of:

generating tactile and tonal vibration energy and audio sensory information via an energy module; and directing the tactile and tonal vibration energy to the treatment site on the animal that includes a spine of the animal; and directing the audio sensory information to a set of ears of the animal, wherein the tactile and tonal vibration energy and audio sensory information are delivered to the animal simultaneously;

wherein the energy module includes a vibration speaker, a programmable control board for controlling an output of the vibration speaker, the programmable control board including energy generating sources that are audio files;

a power supply operatively coupled to the programmable control board and the vibration speaker; and a housing adapted to enclose the vibration speaker, the programmable control board and the power supply, the housing having a top overlay and a one piece bottom plate, the one piece bottom plate including a first concave portion and a second concave portion, a wall of the first concave portion disposed about the one vibration speaker disposed therein, the second concave portion being lateral to the first concave portion and supporting therein the programmable control board and the power supply within the housing, wherein an outer surface of the first concave portion of the one piece bottom plate supports the vibration speaker which is configured for operative contact with the treatment site.

2. The method of claim 1 wherein the step of directing tactile and tonal vibration energy to the spine of the animal includes directing the vibration energy from the vibration speaker in operative contact with the spine of the animal, and wherein the step of directing the audio sensory information includes directing the audio sensory information from the vibration speaker and pad assembly to the animal ears at a tone and frequency of 60 beats per minute.

3. The method of claim 2 further including the step of coupling the vibration speaker to a wearable member, the wearable member adapted to support and locate the vibration speaker on the spine.

4. The method of claim 2, wherein the tactile and tonal vibration energy has a frequency range of 15 Hz to 200 Hz and the audio sensory information includes at least one of a recorded heartbeat and recorded music.

5. An apparatus for delivering therapeutic energy to a treatment site of an animal for a selected condition comprising:

a vibration speaker adapted to generate tactile and tonal vibration energy and audio sensory information;

a controller for controlling an output of the vibration speaker, the controller including an audio file playing module;

a power supply operatively coupled to the controller and the vibration speaker; and housing adapted to enclose the vibration speaker, the controller and the power supply, wherein the housing is adapted to support the vibration speaker in an orientation which is in operative contact with the treatment site of the animal;

wherein the housing comprises a top overlay and a one piece bottom plate, the one piece bottom plate including a first concave portion and a second concave portion, a wall of the first concave portion disposed about the vibration speaker disposed therein, the second concave portion being lateral to the first concave portion and supporting therein the controller and the power supply within the housing, wherein an outer surface of the first concave portion of the one piece bottom plate supports the vibration speaker which is configured for operative contact with the treatment site.

6. The apparatus of claim 5 further including a microswitch and at least one LED.

7. The apparatus of claim 6 wherein the housing is configured to support the vibration speaker between a pair of outer opposing portions of the housing.

8. The apparatus of claim 5 wherein the housing is configured to include a port connection for managing data and to provide an external energy charging input.

9. A device for delivering a therapeutic treatment comprising:

an energy module including only one vibration speaker adapted to generate tactile and tonal vibration energy and audio sensory information;

wherein the energy module is operable separate from a wearable member and further includes:

a programmable control board for controlling an output of the vibration speaker, the programmable control board including energy generating sources that are audio files;

a power supply operatively coupled to the programmable control board and the vibration speaker; and a housing adapted to enclose the vibration speaker, the programmable control board and the power supply, the housing having a top overlay and a one piece bottom plate, the one piece bottom plate including a first concave portion and a second concave portion, a wall of the first concave portion disposed about the one vibration speaker disposed therein, the second concave portion being lateral to the first concave portion and supporting therein the programmable control board and the power supply within the housing, wherein an outer surface of the first concave portion of the one piece bottom plate supports the vibration speaker which is configured for operative contact with a treatment site.

10. The device of claim 9 further comprising a wearable member for use about an upper torso of a user for supporting the energy module such that the outer surface of the first concave portion with vibration speaker is oriented and adapted to be in operative contact with the treatment site, wherein the treatment site is a neck and spine and wherein the energy module is adapted to deliver the tactile vibration energy from the vibration speaker within the first concave portion to the neck and spine and deliver the tonal vibration energy and audio sensory information to the ears.

11. The device of claim 9, wherein the second concave portion of the one piece bottom plate of the housing is comprised of two lateral concave portions, wherein each of the lateral concave portions are located on opposite sides of the first concave portion of the one piece bottom plate.

* * * * *